US009670758B2

(12) United States Patent
Wilson et al.

(10) Patent No.: US 9,670,758 B2
(45) Date of Patent: Jun. 6, 2017

(54) COAXIAL GAS RISER FOR SUBMERSIBLE WELL PUMP

(71) Applicant: Baker Hughes Incorporated, Houston, TX (US)

(72) Inventors: Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 14/537,381

(22) Filed: Nov. 10, 2014

(65) Prior Publication Data

US 2016/0130922 A1 May 12, 2016

(51) Int. Cl.
*E21B 43/12* (2006.01)
*E21B 43/38* (2006.01)
*F04B 47/06* (2006.01)

(52) U.S. Cl.
CPC ..... *E21B 43/128* (2013.01); *E21B 43/38* (2013.01); *F04B 47/06* (2013.01)

(58) Field of Classification Search
CPC ..... E21B 43/128; E21B 43/38; F04B 47/06
See application file for complete search history.

(56) References Cited

U.S. PATENT DOCUMENTS 2,525,233 A * 10/1950 Miller ..... E21B 43/38 166/105.5
6,932,160 B2 8/2005 Murray et al.
8,141,625 B2 3/2012 Reid
2004/0238179 A1* 12/2004 Murray ..... E21B 43/38 166/369

* cited by examiner

*Primary Examiner* — George Gray
(74) *Attorney, Agent, or Firm* — Bracewell LLP; James E. Bradley

(57) ABSTRACT

A centrifugal well fluid pump has a pump intake and a pump discharge conduit extending upward from the pump. A barrier between the motor and the pump intake seals to casing in a well. A bypass tube extends from below the barrier, alongside the pump and has an outlet at an upper end of the pump. A riser surrounds the pump discharge conduit, the riser having a riser inlet in fluid communication with the bypass tube outlet. Liquid portions of the well fluid flow upward through the riser to discharge from the riser outlet and flow down to the pump intake. Gaseous portions of the well fluid flow upward through the riser and continue flowing upward into the casing.

14 Claims, 1 Drawing Sheet

COAXIAL GAS RISER FOR SUBMERSIBLE WELL PUMP

FIELD OF THE DISCLOSURE

This disclosure relates in general to submersible well fluid pumps and in particular to a gas bypass tube extending alongside the pump to a riser extending upward from the pump and surrounding the production tubing, the riser having an open upper end.

BACKGROUND OF THE DISCLOSURE

Electrical submersible pumps (ESP) are often employed to pump well fluid from wells. A typical ESP includes a rotary pump driven by an electrical motor. Normally, the ESP is suspended in the well on a string of production tubing. A seal section, usually located between the motor and the pump, has a movable element to reduce a pressure differential between the well fluid exterior of the motor and motor lubricant contained in the motor. The pump may be a centrifugal pump having a plurality of stages, each stage having an impeller and a diffuser.

Some wells produce gas along with liquid, and centrifugal pumps operate best when pumping primarily liquid. Gas separators of various types may be employed to separate the gas from the liquid prior to reaching the pump. However, some gas may still reach the pump, particularly when the well fluid contains slugs or large bubbles of gas.

Shrouds may be employed in various ways to cause gas separation before reaching the pump intake. In one design, the shroud surrounds the pump and has an inlet at an upper end. Well fluid flows upward around the shroud, then downward into the inlet and to the pump intake. As the well fluid turns to flow downward, gas in the well fluid tends to continue flowing upward while the heavier liquid portions flow downward into the shroud inlet. Having a large enough annulus between the shroud and casing can be a problem with some wells.

U.S. Pat. No. 6,932,160 discloses system using a riser offset from a longitudinal axis of the ESP. The riser has an inlet extending through a barrier in the well below the pump intake. The riser has an outlet above the pump intake. As well fluid discharges from the bypass tube outlet, the gas portions tend to continue flowing upward while the liquid portions flow downward to the pump intake. The bypass tube may have helical vanes within to enhance separation of the gas and liquid portions.

SUMMARY

A well fluid pump assembly has a motor that drives a pump. The pump has a pump intake and a pump discharge conduit extending upward from the pump along a longitudinal axis of the pump. A bypass tube has a bypass tube inlet isolated from fluid communication with the pump intake so as to cause all of the well fluid entering the pump intake to flow first into the bypass tube and out a bypass tube outlet. A riser surrounds the pump discharge conduit and has a riser inlet in fluid communication with the bypass tube outlet for receiving all of the well fluid flowing through the bypass tube. The riser has a riser outlet above an effective level of the pump intake. Liquid portions of the well fluid flowing through the riser discharge from the riser outlet and flow down to the pump intake. Gaseous portions of the well fluid flowing through the riser flow upward from the riser outlet.

In the embodiment shown, the riser inlet is located at least above an upper end of the pump. Also, the riser is coaxial with the axis of the pump. The bypass tube extends alongside the pump, and the bypass tube outlet is adjacent an upper end of the pump.

The riser inlet and bypass tube outlet may include an offset member that extends laterally between the riser inlet and the bypass tube outlet. The offset member has an interior in fluid communication with the bypass tube outlet and the riser inlet.

An annular area between the riser and the discharge conduit has a cross-sectional flow area at least equal and preferably greater than a cross-sectional flow area of the bypass tube. Helical flighting may be located on an interior wall of the riser. The flighting extends substantially from the riser inlet to the riser outlet. The riser has an outer diameter at least equal to a maximum outer diameter of the pump. The riser has an axis that is offset from an axis of the bypass tube.

A barrier located below the pump intake and above the motor seals within casing in the well. The barrier isolates the pump intake from the riser inlet.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
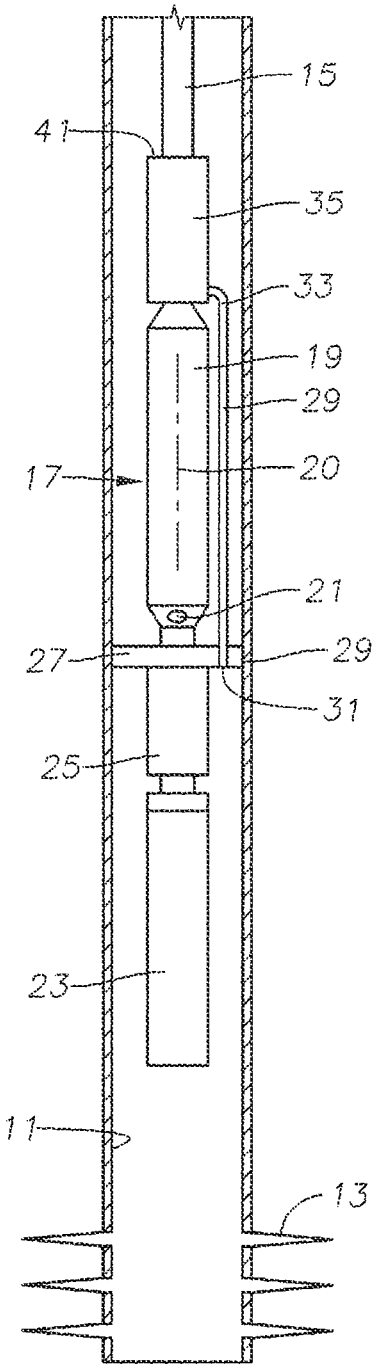
FIG. 1 is a side view of an electrical submersible pump assembly in accordance with this disclosure installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to skilled in the art. In the drawings and specification, there have been disclosed illustrative embodiments and, although specific terms are employed, they are used in a generic and descriptive sense only and not for the purpose of limitation.

Referring to FIG. 1, the well has a casing 11 containing a set of perforations 13 or other openings to allow the flow of formation fluid into casing 11. A string of production tubing 15 extends into casing 11 and is supported at an upper end by a wellhead (not shown). Production tubing 15 may comprise separate joints of pipe with threaded ends secured together, or it may be a single continuous string of coiled tubing 15.

Figure 2:
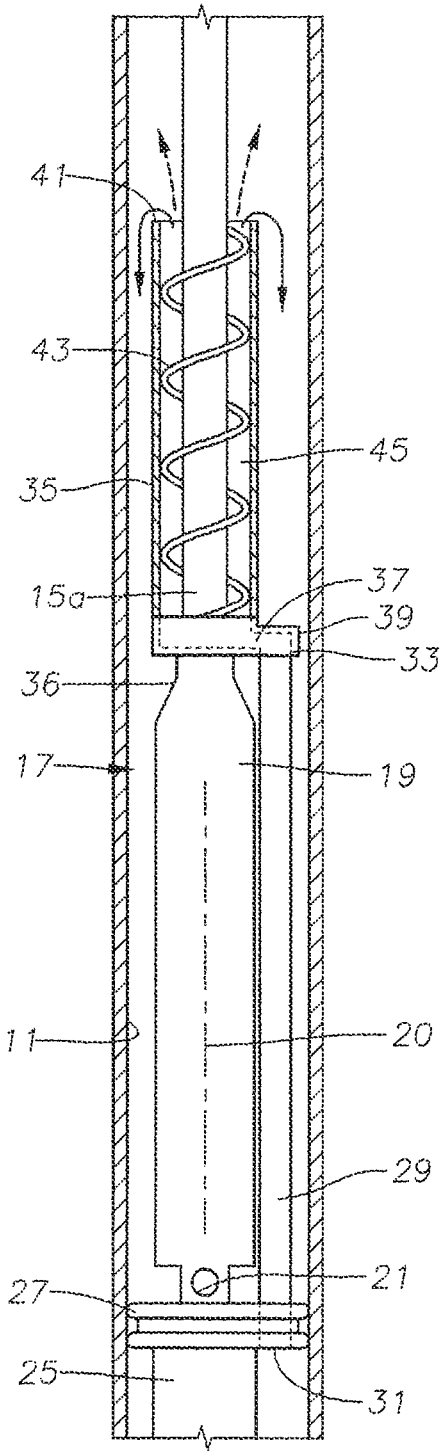
FIG. 2 is an enlarged partially sectional view of an upper portion of the pump assembly of FIG. 1.

An electrical submersible pump assembly (ESP) 17 secures to the lower end of production tubing 15. Although shown vertically oriented in the drawings, ESP 17 may be located within inclined or horizontal portions of casing 11. The terms "upper" and "lower" are used herein only for convenience and not in a limiting manner because ESP 17 may be installed in other than a vertical orientation. ESP 17 includes a pump 19, normally a centrifugal pump having a large number of stages, each stage comprising an impeller and a diffuser. Pump 19 has a longitudinal axis 20 that coincides with the axis of production tubing 15. Pump 19 has a discharge conduit 15*a* (FIG. 2) on its upper end that may be considered to be a lower portion of production tubing 15*a*. Discharge conduit 15*a* has an outer diameter that is smaller than a maximum outer diameter of pump 19. Discharge conduit 15*a* optionally may have a smaller outer diameter than the remaining portion of production tubing 15. Pump 19 has an intake 21 shown to be at its lower end. ESP 17 optionally could incorporate a gas separator (not shown) below pump 19, and if so the effective level of pump intake 21 would be at a lower end of the gas separator.

A motor 23 has a rotating drive shaft (not shown) that drives pump 19. Motor 23 is typically an electrical three-phase motor filled with a dielectric lubricant. A pressure equalizer or seal section 25 couples to motor 23 for reducing a pressure differential between the dielectric lubricant and hydrostatic well fluid pressure. In this example, seal section 25 has a lower end secured to motor 23 and an upper end secured to pump 19. Alternately, seal section 25 could be mounted to a lower end of motor 23.

A barrier 27 seals around ESP 17 and to casing 11 to prevent well fluid flowing in perforations 13 from flowing directly to pump intake 21. In this embodiment, barrier 27 is located below pump intake 21 and above motor 23 at an upper end of seal section 25. Barrier 27 may comprise a packer element having an expandable or inflatable elastomeric member. Optionally, barrier 27 could be below motor 23 if provisions are made to flow well fluid past motor 23 for cooling. For example, one provision could be to employ a circulation tube (not shown) extending downward from one of the stages of pump 19 to below motor 23 to divert a portion of the well fluid being pumped.

A bypass tube 29 delivers well fluid flowing in perforations 13 through barrier 27 and to a point above pump intake 21. Bypass tube 29 extends through barrier 27 and has a bypass tube inlet 31 at the lower side of barrier 27. Bypass tube 29 extends alongside pump 19 and has an axis that is offset and parallel to pump axis 20. Bypass tube 29 has a bypass tube outlet 33 located equal to or above the upper end of pump 19. Bypass tube 29 may have a transverse cross-sectional shape that is other than cylindrical so as to increase the flow area through bypass tube 29. For example, the cross-sectional shape may be generally crescent shaped with rounded tips extending partly around pump 19.

A riser 35 mounts to the upper end of pump 19 and extends upward a selected distance around pump discharge conduit 15*a*. The length of riser 35 may vary. Riser 35 is a cylindrical member that is coaxial with pump discharge conduit 15*a*. The axis of riser 35 coincides with pump axis 20. The axis of bypass tube 29 is offset and parallel to the axis of riser 35. Riser 35 has an outer diameter that is preferably at least equal to the maximum outer diameter of pump 19. In the example, shown, the upper end of pump 19 has an optional neck 36 that tapers down in diameter from the maximum diameter pump 19 to approximately the outer diameter of pump discharge conduit 15*a*. The lower end of riser 35 is located at an upper end neck 36. Neck 36 could be considered to be a lower end of pump discharge conduit 15*a*.

Riser 35 has a riser inlet 37 on its lower end that joins an offset member 39 extending a short distance laterally outward from riser inlet 37. Offset member 39 joins bypass tube outlet 33, and the interior of offset member 39 communicates well fluid flowing up bypass tube 29 to riser 35. Offset member 39 may be considered to be either a part of riser inlet 37 or a part of bypass tube outlet 33. The flow area within offset member 39 is at least equal to the flow area within bypass tube 29.

Riser 35 has a riser outlet 41 that is shown to be an open upper end of riser 41. Riser outlet 41 could also include apertures (not shown) spaced along an upper portion of the side wall of riser 35. Helical fighting or vanes 43 optionally may be mounted to the interior side wall of riser 35. Vanes 43 causes rotation of well fluid flowing up riser 35, and may extend the full length of riser 35, from riser inlet 37 to riser outlet 41. Vanes 43 are shown schematically as a single, helical vane, but preferably comprise multiple vanes arranged in symmetric multiples to avoid an unbalanced swirling liquid/gas core of the well fluid. Preferably, bypass tube 29 does not have helical vanes or fighting.

The interior of riser 35 defines an annular space 45 surrounding pump discharge conduit 15*a*. The transverse cross-sectional flow area of annular space 45 is at least equal to the cross-sectional flow area of bypass tube 29 and preferably greater. The flow area of annular space 45 may also be greater than the flow area of pump discharge 15*a*. The outer diameter of riser 35 is greater than the outer diameter of production tubing 15.

During operation, motor 23 drives pump 19, causing well fluid flowing inward from perforations 13 to flow past motor 23 and into bypass tube inlet 31. The well fluid normally contains gas and liquid components, and all of the upward flowing well fluid will flow into bypass tube 29. The well fluid flows up bypass tube 29, out bypass tube outlet 33, through offset member 39 and into riser inlet 37. The gas and liquid components may still be mixed together at this point. As the well fluid flows up riser 35, vanes 43 cause swirling of the well fluid. The swirling action results in the heaver or denser components, principally liquid, to migrate outward and separate from the lighter gaseous components. The liquid portion thus migrates outward toward the inner diameter of riser 35, while the gas portion migrates inward to the outer diameter of pump discharge conduit 15*a*. As both portions exit riser outlet 35, gravity causes the heavier liquid portion, indicated by solid arrows, to turn and flow downward. The lighter gas portion, indicated by the dotted arrows, flows upward in the annulus between production tubing 15 and casing 11 to the wellhead (not shown). The heavier liquid portion flows down the annulus between riser 35 and casing 11 to pump intake 21. This portion of the well fluid will be pumped upward by pump 19 and out pump discharge conduit 15*a* into production tubing 15 for delivery to the wellhead.

The flow area of riser annular space 45 is made as large as feasible to increase the residence time of well fluids as they flow up annular space 45. The increase in residence time helps the liquid and gas portions within the well fluid to separate while still in riser 35. Also, the increase in flow area of annular space 45 reduces the tendency of the gas and liquid portions to remix after separation due to the effect of a stagnant boundary layer occurring on the inner diameter of riser 35.

The portion of production tubing 15 considered to be the pump discharge conduit 15*a* should extend at least the length of riser 35. Pump discharge conduit 15*a* should be smooth and free of disruptions to facilitate the separation of gas and liquid, within riser 35. Pump discharge conduit 15*a* could be made smaller in outer diameter than the outer diameter of the upper portion of production tubing 15 so as to increase the cross-sectional flow area of annular space 45 within riser 35.

While the disclosure has been shown in only one of its forms, it should be apparent to those skilled in the art that it is susceptible to various modifications.

The invention claimed is:

1. A well fluid pump assembly, comprising:

a motor;

a pump operatively coupled to and driven by the motor, the pump having a longitudinal pump axis, a pump intake and having a pump discharge conduit extending upward from the pump;

a bypass tube extending alongside the pump and having a longitudinal bypass tube axis offset from and parallel to the pump axis, the bypass tube having a bypass tube inlet, the bypass tube inlet being isolated from fluid communication with the pump intake so as to cause all of the well fluid entering the pump intake to flow first into the bypass tube inlet and out a bypass tube outlet;

a riser surrounding the pump discharge conduit, the riser having a riser inlet at or above an upper end of the pump and connected with the bypass tube outlet for receiving all of the well fluid flowing through the bypass tube;

the riser having a riser outlet, causing liquid portions of the well fluid flowing through the riser to discharge from the riser outlet, turn and flow downwardly to the pump intake, and causing gaseous portions of the well fluid flowing through the riser to discharge from the riser outlet in a direction opposite to the downward flow of the liquid portions; and wherein a riser annular flow area between the riser and the discharge conduit from the riser inlet to the riser outlet is greater than a cross-sectional flow area of the bypass tube.

2. The assembly according to claim 1, wherein a connection between the bypass tube outlet and the riser inlet is offset from an axis of the discharge conduit.

3. The assembly according to claim 1, wherein:

the discharge conduit has a lower end below the riser inlet.

4. The assembly according to claim 1, wherein:

the annular riser flow area is greater than a cross-sectional flow area of the discharge conduit.

5. The assembly according to claim 1, further comprising:

helical flighting on an interior wall of the riser, the flighting extending substantially from the riser inlet to the riser outlet.

6. The assembly according to claim 1, wherein the riser has an outer diameter greater than a maximum outer diameter of the pump.

7. The assembly according to claim 1, further comprising:

a barrier located below the pump intake for sealing within casing in the well, the barrier isolating the pump intake from well fluid below the barrier; wherein the bypass tube inlet extends through the barrier to cause well fluid from below the barrier to flow into the bypass tube inlet.

8. A well fluid pump assembly, comprising:

a motor;

a pump operatively coupled to and driven by the motor, the pump having a pump intake and having a pump discharge conduit extending upward from the pump along a longitudinal axis of the pump;

a barrier below the pump intake for sealing to a casing in a well;

a bypass tube having a bypass tube inlet, the bypass tube inlet extending through the barrier for receiving well fluid flowing up the casing from below the barrier, the bypass tube extending alongside the pump and having a bypass tube outlet above an upper end of the pump, the bypass tube having a longitudinal axis parallel to and offset from the longitudinal axis of the pump;

a riser surrounding and coaxial with the pump discharge conduit, the riser having a riser inlet above the pump and connected with the bypass tube outlet for receiving all of the well fluid flowing through the bypass tube;

the riser having a riser outlet above the riser inlet, causing liquid portions of the well fluid flowing upward through the riser to discharge from the riser outlet and flow down to the pump intake, and causing gaseous portions of the well fluid flowing upward through the riser to flow upward from the riser outlet into the casing; and wherein a riser annular flow area between the riser and the discharge conduit from the riser inlet to the riser outlet is greater than a cross-sectional flow area of the bypass tube.

9. The assembly according to claim 8, wherein:

the riser annular flow area is greater than a cross-sectional flow area of the discharge conduit.

10. The assembly according to claim 8, further comprising:

helical flighting on an interior wall of the riser, the flighting extending substantially from the riser inlet to the riser outlet.

11. The assembly according to claim 8, wherein the riser has an outer diameter at greater than a maximum outer diameter of the pump.

12. A method of pumping a well fluid containing gas and liquid from a well having a string of tubing suspended in casing, comprising:

(a) mounting a pump with a discharge conduit and a motor to the tubing, extending a riser from an upper end of the pump upward a selected distance around and coaxial with the discharge conduit, sizing the discharge conduit and the riser to provide a riser annular flow area between the riser and the discharge conduit from a riser inlet to a riser outlet that is greater than a cross-sectional flow area of the bypass tube and extending a bypass tube alongside the pump the bypass tube having an inlet below an intake of the pump and an outlet at a lower end of the riser, the bypass tube having a longitudinal axis parallel to and offset from a longitudinal axis of the pump, and connecting the outlet of the bypass tube to the riser inlet;

(b) operating the pump with the motor;

(c) flowing well fluid into the inlet of the bypass tube, upward through the bypass tube and out the outlet of the bypass tube into the riser inlet, and discharging the well fluid from the riser outlet at an elevation above the intake of the pump; and (f) causing the well fluid being discharged from the riser outlet to flow downward toward the intake of the pump, thereby releasing some of the gas contained therein to flow upward in the casing while the remaining portion of the well fluid flows into the intake of the pump and is discharged by the pump into the tubing.

13. The method according to claim 12, wherein step (a) comprises providing the discharge conduit with an outer diameter that is less than an outer diameter of the tubing.

14. The method according to claim 12, further comprising:

setting a barrier in the well that seals to the casing below the intake of the pump; and extending the inlet of the bypass tube below the barrier.

* * * * *